US008313234B2

(12) United States Patent
Kapshitzer

(10) Patent No.: US 8,313,234 B2
(45) Date of Patent: Nov. 20, 2012

(54) COAXIAL HOROLOGICAL MOVEMENT

(75) Inventor: Arny Kapshitzer, Geneva (CH)

(73) Assignee: Parmigiani Fleurier SA (CH)

( * ) Notice: Subject to any disclaimer, the term of this patent is extended or adjusted under 35 U.S.C. 154(b) by 247 days.

(21) Appl. No.: 12/921,245

(22) PCT Filed: Mar. 11, 2008

(86) PCT No.: PCT/IB2008/050882

§ 371 (c)(1),
(2), (4) Date: Sep. 7, 2010

(87) PCT Pub. No.: WO2009/112884

PCT Pub. Date: Sep. 17, 2009

(65) Prior Publication Data

US 2011/0019505 A1 Jan. 27, 2011

(51) Int. Cl.
*G04B 15/00* (2006.01)

(52) U.S. Cl. ..... 368/127

(58) Field of Classification Search ..... 368/220, 368/127, 124–125, 157–158, 160–161, 168–169
See application file for complete search history.

(56) References Cited

U.S. PATENT DOCUMENTS

| | | | | |
|---|---|---|---|---|
| 4,090,352 | A * | 5/1978 | Jeannet et al. | 368/220 |
| 4,259,735 | A * | 3/1981 | Vuille | 368/34 |
| 4,465,381 | A * | 8/1984 | Cleusix | 368/250 |
| 2011/0051566 | A1* | 3/2011 | Ono | 368/220 |

* cited by examiner

*Primary Examiner* — Edwin A. Leon
(74) *Attorney, Agent, or Firm* — Galbreath Law Offices, P.C.; John A. Galbreath

(57) ABSTRACT

Horological movement that includes an energy accumulator, wheel units fitted with time indicator members, kinematic connection means creating multiplication or demultiplication ratios between the different wheel units, and a regulator member. The energy accumulator, the wheel units and the regulator member are arranged coaxially. Each wheel unit possesses a shape similar to a cup, each cup having a different diameter to allow it to fit partially one inside the other. The horological movement also has a differential arranged coaxially with the energy accumulator to provide the kinematic connection between the energy accumulator and one of the cups through a main arbour and a main pipe which is fitted coaxially around the main arbour, the pipe being designed to support both the other cup or cups and the said kinematic connection means. One of the cups preferably corresponds to the second wheel unit in which the regulator member is located.

10 Claims, 8 Drawing Sheets

COAXIAL HOROLOGICAL MOVEMENT

The present invention relates to the field of horology and more particularly to a coaxial horological movement.

BACKGROUND OF THE INVENTION

A simple horological movement consists of a barrel (energy accumulating member), gear wheel trains (transmission members), an escapement (energy distributing member) and a balance/balance spring (regulating member). These components are generally mounted on a plurality of arbors that are distributed over the entire plate or on bridges arranged on the latter. In this configuration, the assembling of these elements has the consequence of limiting the extent to which the size of the movement can be reduced.

DESCRIPTION OF THE PRIOR ART

Document EP0681227 discloses a mechanical horological piece comprising an hour wheel unit and a minute wheel unit, each wheel unit being composed of a transparent disk on which a minute hand and an hour hand respectively are formed by electroplating. A feature of this horological piece is that it comprises a tourbillon arranged at its center and mounted coaxially with the hour wheel unit, the minute wheel unit and the barrel.

Moreover, the two display disks comprise on their periphery crowns made from a metal material and having a shoulder that allows the corresponding disk to be accommodated. The drive crowns are adhesively bonded to the display disks and they comprise a radial outer set of teeth at their periphery.

The multiplication ratios between the barrel and the tourbillon are obtained by virtue of a first gear wheel train, whereas the multiplication ratios between the barrel and the display disks are obtained by virtue of a second gear wheel train engaging with the radial set of teeth of the drive crowns.

The different arbors comprising the gear wheels of the first and the second gear train are arranged on the plate outside the perimeter inside which the barrel and the cage of the tourbillon are situated. The arrangement of some gear wheels goes well beyond the periphery of this zone in order to be able to mesh with the different drive crowns situated on the periphery of the display disks.

Consequently, although the barrel, the time indicating members and the tourbillon are arranged in the center of the horological movement, the size of the latter is, however, not reduced since the peripheral gear wheel trains are essential for ensuring an appropriate rotation of the different members.

SUMMARY OF THE PRESENT INVENTION

The object of the present invention is thus to propose a coaxial horological movement that allows the size of the horological movement to be substantially reduced.

In accordance with the invention, this object is achieved by a horological movement as claimed in claim 1. This movement comprises an energy accumulator, wheel units on which are arranged time indicating members, kinematic connection means creating the multiplication and demultiplication ratios between the different wheel units and a regulating member. Demultiplication is equivalent to reduction, and thus a demultiplication ratio is a reduction ratio. The energy accumulator, the wheel units and the regulating member are arranged coaxially. Each wheel unit has a shape similar to a cup, each cup having a different diameter to allow them to fit partially one inside the other. The horological movement also comprises a differential arranged coaxially with the energy accumulator to provide the kinematic connection between the energy accumulator and one of the cups through a main arbor and a main pipe which is fitted coaxially around the main arbor, said pipe being designed to support both the other cup or cups and said kinematic connection means. One of the cups preferably corresponds to the seconds wheel unit in which the regulating member is located.

DESCRIPTION OF THE DRAWINGS

The features of the invention will become more apparent upon reading a description of an embodiment given purely by way of example and with no limitation being implied, with reference to the diagrammatic figures, in which.

DESCRIPTION OF THE PREFERRED EMBODIMENTS

Figure 3:
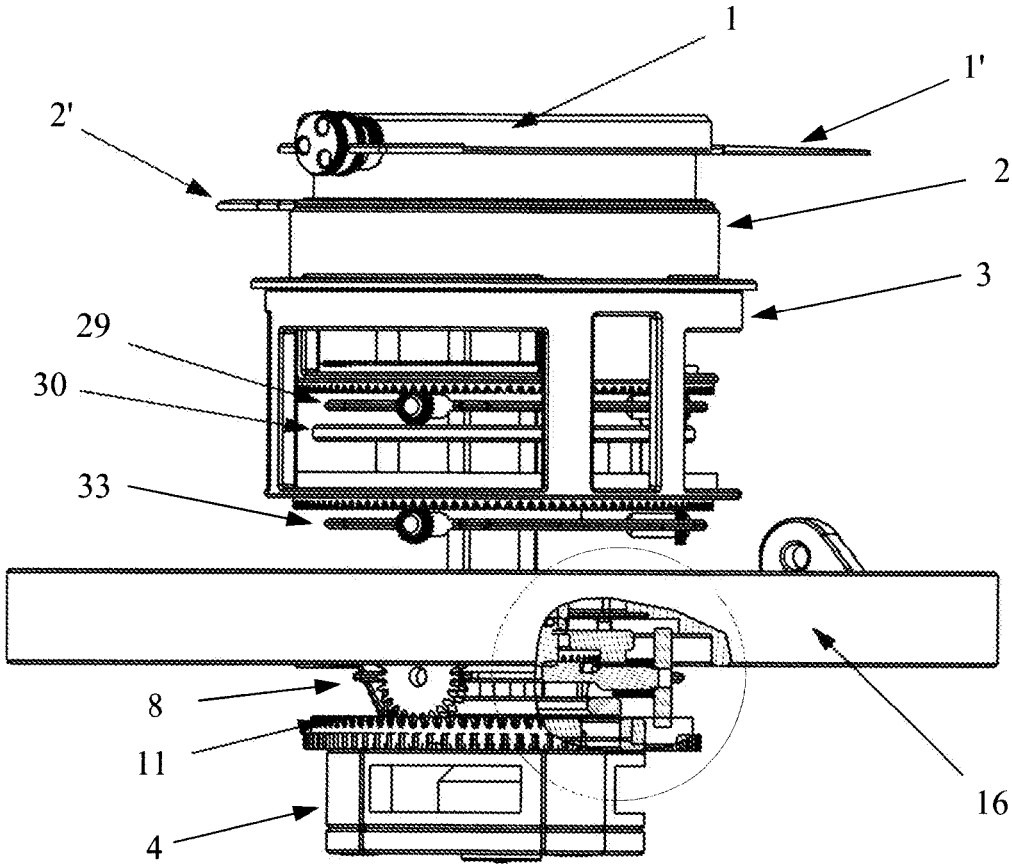
FIG. 3 shows a front view of the assembled horological movement.

According to the main embodiment of the present invention, the mechanical horological movement comprises a wheel unit for the seconds (1), the minutes (2) and the hours (3), all three being similar to a respective cup. These cups (1, 2, 3) are arranged coaxially with the barrel (4) and the balance/balance spring (5, 6) of the movement. According to FIGS. 3 and 6, the seconds cup (1) is arranged partially inside the minute cup (2), whilst the latter is itself arranged partially inside the hour cup (3).

The energy required for the movement to function is supplied by the barrel (4). The latter is connected kinematically to one of the ends of a main arbor (7) via a barrel differential (8) that allows the travel of the barrel (4) to be multiplied by the means described below.

Figure 16:
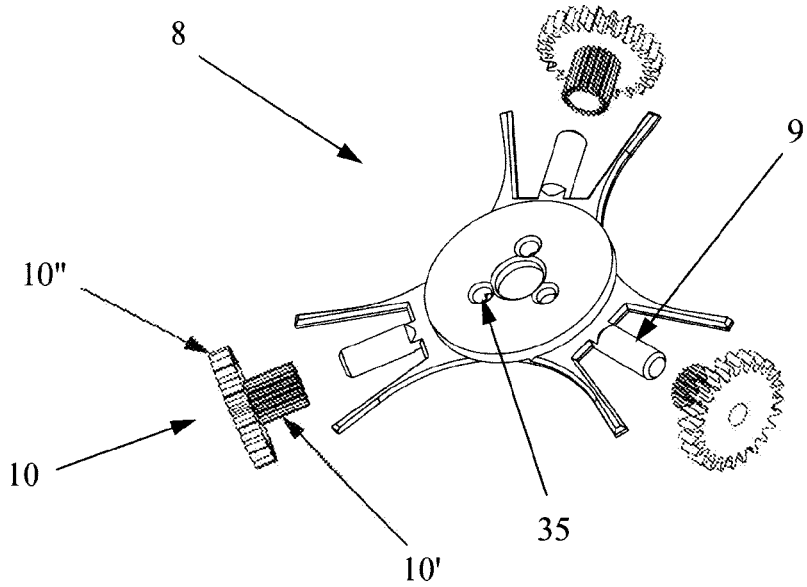
FIG. 16 is an exploded diagrammatic representation of the barrel differential.

As can be seen in FIG. 16, this barrel differential (8), supported by a support (8') (FIG. 2), consists of an annular central part intended to be fitted onto a stationary main pipe (15) arranged coaxially with the main arbor (7) and integral with the plate (16) of the movement. This differential (8) is provided with three rods (9) arranged radially on the periphery of the central part at 120° relative to one another. A conical pinion (10) comprising a first and a second diameter (10', 10") is fitted freely on each rod (9).

Figure 4:
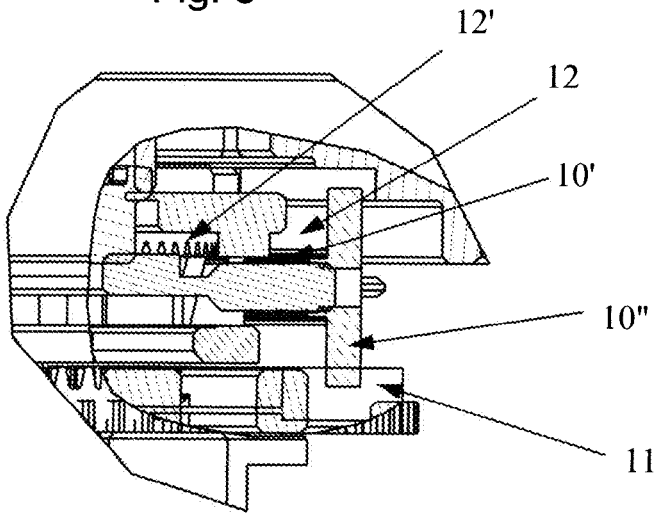
FIG. 4 shows a detailed view of FIG. 3 showing part of a barrel differential.
Figure 6:
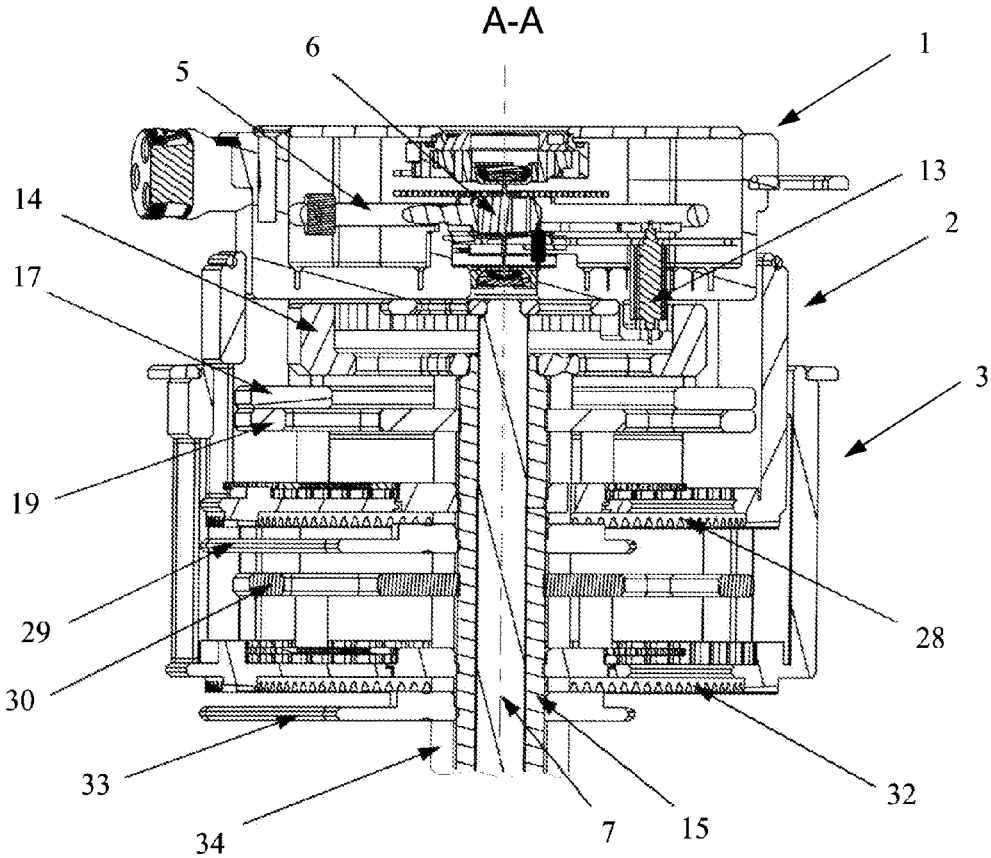
FIG. 6 shows a partial cross-sectional view of FIG. 5 along the line A-A.

According to FIG. 4, the part of the pinion with the smaller diameter (10') engages with the barrel wheel (11), whilst the part of the pinion with the greater diameter (10") engages with a disk (12) provided with a circular rack (12'), said disk (12) being integral with the main arbor (7) (FIG. 6). The number and distribution of the pinions (10) have been determined so as to evenly distribute the mechanical stresses over the periphery of the rack (12') of the disk (12).

The gearing ratios between the barrel wheel (11), the pinions (10) and the rack (12') have been determined so as to impart a rotation of 360° per minute to the main arbor (7).

Figure 5:
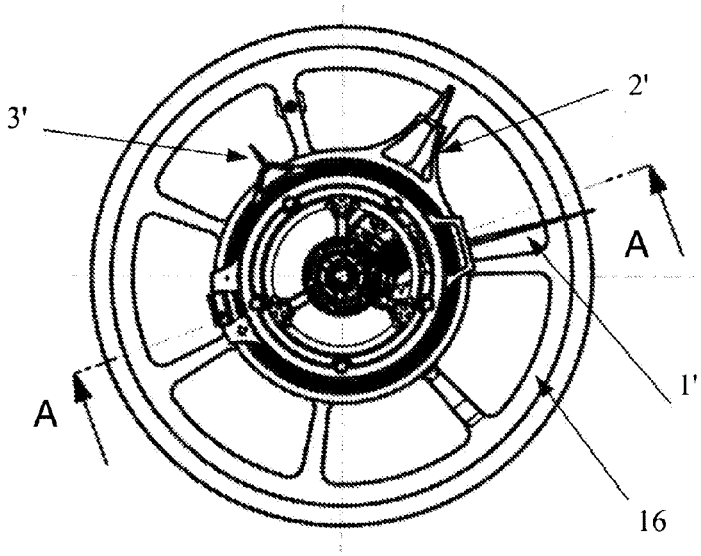
FIG. 5 shows a top view of the horological movement.
Figure 7:
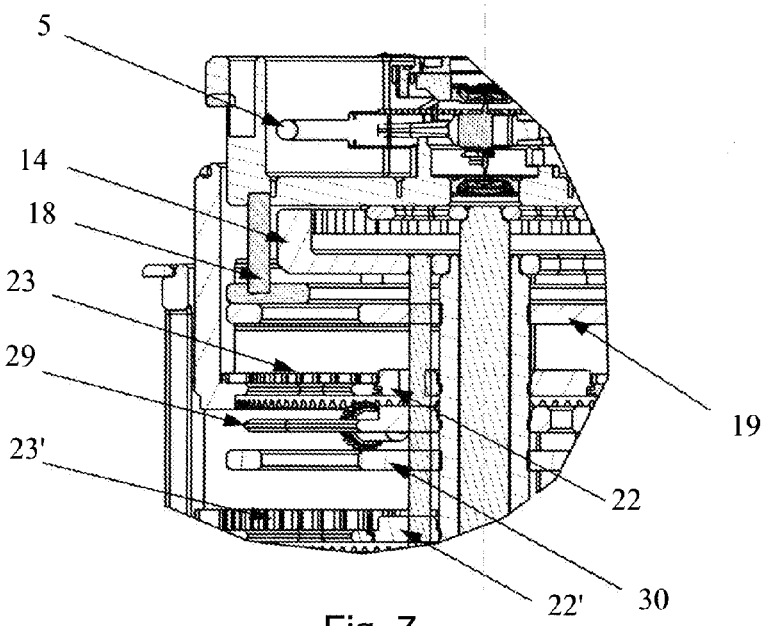
FIG. 7 shows a detailed partial view of FIG. 6, FIG. 8 a diagrammatic top view of a minute wheel unit, hour wheel unit or complication wheel unit.

According to FIGS. 6 and 7, the seconds cup (1) is situated on the upper part of the horological movement and is integral with the upper end of the main arbor (7). The balance/balance spring (5, 6) and the escapement, the latter being in engagement with said balance/balance spring (5, 6), are arranged inside the cup (1) and can thus be seen in their entirety on the dial side of a watch such as that illustrated in FIG. 5. This particular arrangement has the advantage of rotating the balance/balance spring (5, 6) and the escapement about themselves, thus performing the function of a central tourbillon, it being possible for the seconds cup (1) to be assimilated with the cage of the tourbillon.

As can be seen in FIG. 6, the escapement pinion (13) is arranged so that it meshes with a crown wheel (14) situated beneath the seconds cup (1). The base of this crown (14) is set directly on the main pipe (15). The crown wheel (14) is therefore stationary, the escapement pinion (13) being capable of rotating 360° per minute on the periphery of said crown (14).

As can be seen in FIG. 6, an annular coupling disk for time setting (17) made of graphite is arranged coaxially and integrally with the seconds cup (1) by means of pins (18). This disk (17) thus makes a complete revolution about the main pipe (15) every 60 seconds. This disk (17) performs a coupling function with respect to another disk (19), also made of graphite, the latter forming part of a planetary gearing system which will be described later.

These annular disks (17, 19) are molded with a very rough surface finish. This allows the two disks (17, 19) to adhere to each other without causing any jumping of the gearing in the mechanism when they are in contact so that the force can be transmitted normally to the different cups (1, 2 and 3). When these two disks (17, 19) are uncoupled, all the cups (1, 2 and 3) can be slid along the main pipe (15) so as to allow the time of the watch to be set by an appropriate device.

The horological movement comprises a first planetary gearing system consisting of the elements as illustrated in the diagrammatic FIGS. 8, 9, 10, 11, 12, 13, 14 and 15 to demultiply the travel of the seconds cup (1) so that the minute cup (2) makes one rotation every hour.

Figure 8:
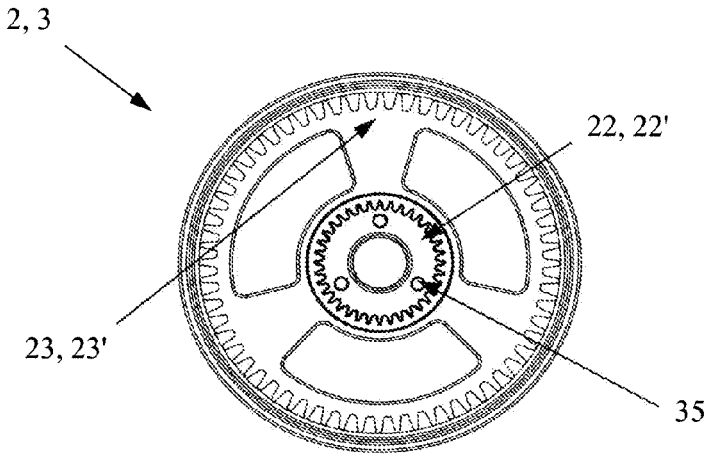
Figure 9:
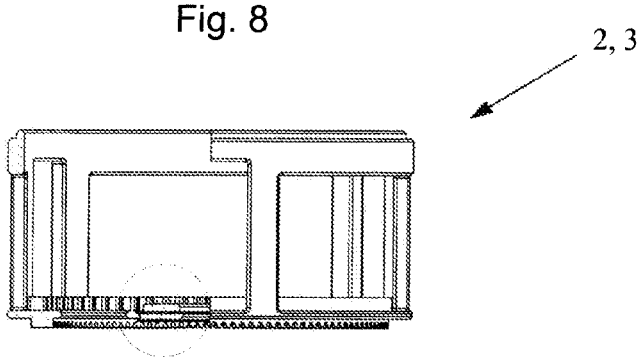
FIG. 9 shows a front view of FIG. 8 comprising a partial cross-section.
Figure 10:
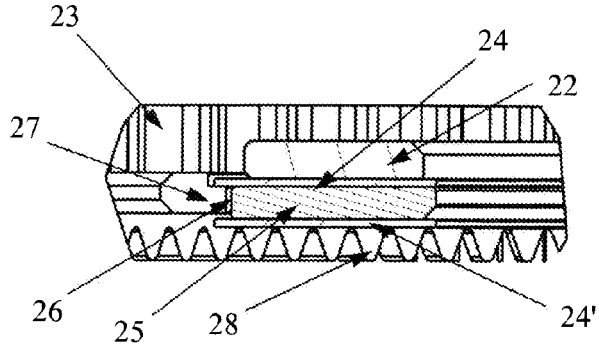
FIG. 10 shows a detailed view of FIG. 9.
Figure 11:
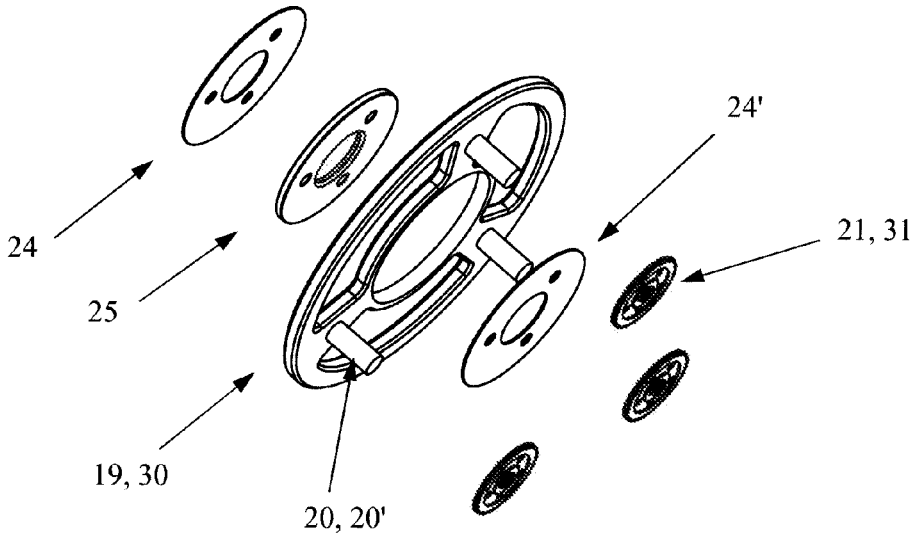
FIG. 11 shows an exploded perspective view of the satellites of a planetary gearing system with its securing elements.
Figure 12:
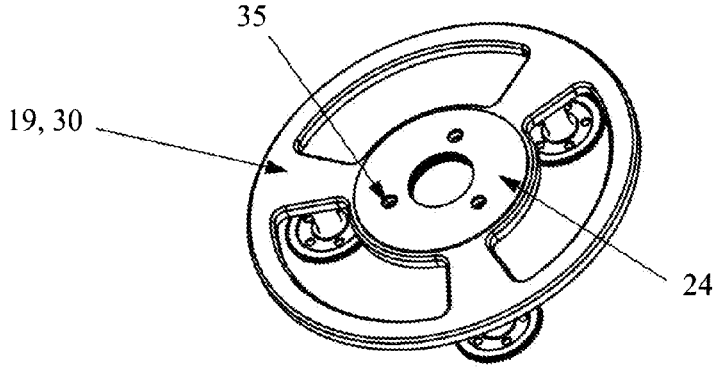
FIG. 12 shows a perspective top view of FIG. 11.

This planetary gearing system consists of the graphite annular disk (19), as illustrated in FIG. 11, provided with three shafts (20) arranged perpendicularly to said disk (19) near its periphery at 120° relative to one another, of three wheels termed the minute satellites (21) arranged freely at each end of the shafts (20), of a crown (20) situated on the inner circumference of the minute cup (2) close to its base, as illustrated in FIGS. 8, 9 and 10, and of a minute pinion (22) set on the main pipe (15) of the movement (FIGS. 7 and 8).

Moreover, three annular disks (24, 24' and 25) are superposed and set coaxially on the main pipe (15) beneath the graphite disk (17) integral with the seconds cup (1). As can be seen in FIG. 11, the outer diameter of the upper and lower disks (24, 24') is slightly greater than the outer diameter of the middle disk (25) so as to create a circular groove (26) so that the inner circumference of the annular graphite disk (19) clips into this groove (26). This groove (26) can be seen in FIG. 10, even though this figure is a diagrammatic representation of the securing of one of the cups (1, 2 3) on the main pipe (15) of the movement by the same principle. The contact surfaces between the graphite disk (19) and the groove (26) have been surface-treated so as to reduce the friction coefficient as much as possible. The three annular disks (24, 24' and 25) preferably have a Teflon coating. The graphite disk (19) can thus be driven about its axis of rotation with a minimum amount of friction.

Figure 13:
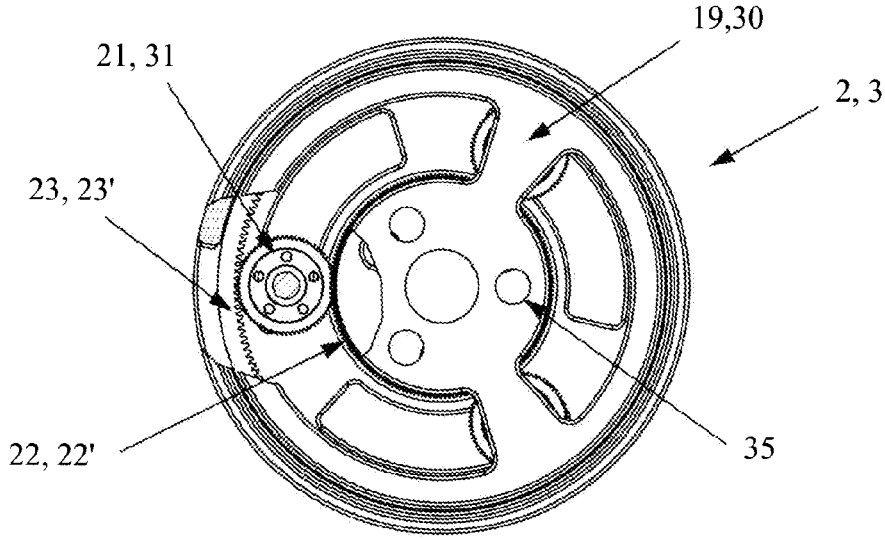
FIG. 13 shows a top view of the planetary gearing system with a partial cross-section.

As can be seen in the diagrammatic FIG. 13, the three minute satellites (21) engage, on the one hand, with the stationary pinion (22) and, on the other hand, with the crown (23) of the minute cup (2). The rotation of the disk (19) drives the three satellites (21) in orbital rotation about the main pipe (15), said satellites driving the minute cup (2) in rotation.

The gearing ratios between the pinion (22), the satellites (21) and the crown (23) have been determined so that the minute cup (2) makes one 360° rotation every hour.

So that the hour cup (2) can, on the one hand, be secured at the right height on the main pipe (15) and, on the other hand, be driven about its axis of rotation, three annular disks (24', 24" and 25') similar to those used to allow the driving of the disk (19) about its axis of rotation (FIG. 11) are superposed and set coaxially on the main pipe (15) beneath the pinion (22). According to FIGS. 9 and 10, the minute cup (2) comprises a shoulder (27) over its entire inner circumference beneath the crown (23), this shoulder (27) being designed so as to be housed in the groove (26) resulting from the assembly of the three annular disks (24', 24' and 25). The minute cup (2) is preferably made of ceramic, whilst the annular disks (24', 24' and 25) [sic] have a Teflon coating in order to reduce the friction coefficient as much as possible. The minute cup (2) can thus be driven about its axis of rotation with a minimum of friction.

As can be seen in FIG. 6, the diameter of the minute cup (2) is greater than that of the seconds cup (1) so that the latter can be arranged coaxially, and partially inside said minute cup (2).

Figure 14:
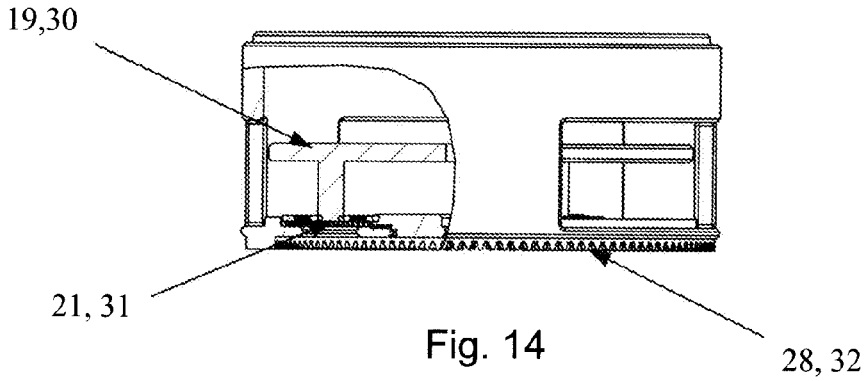
FIG. 14 shows a front view of FIG. 13 with a partial cross-section.
Figure 15:
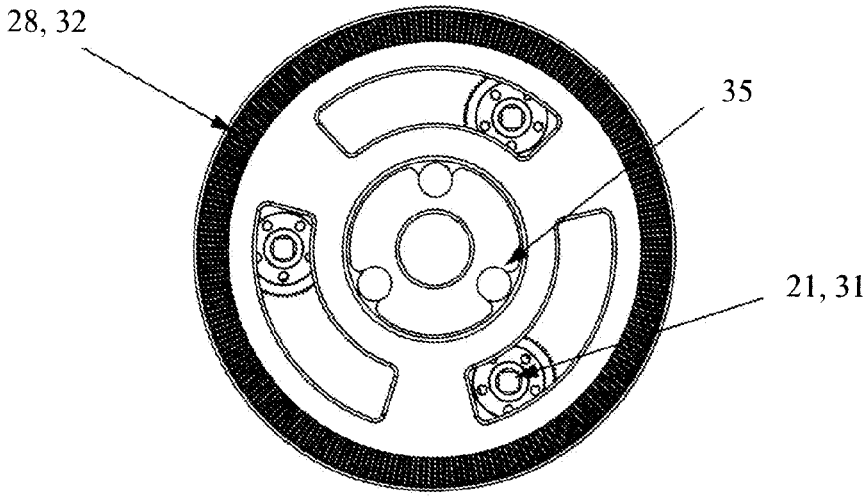
FIG. 15 shows a view from below of FIG. 13.
Figure 17:
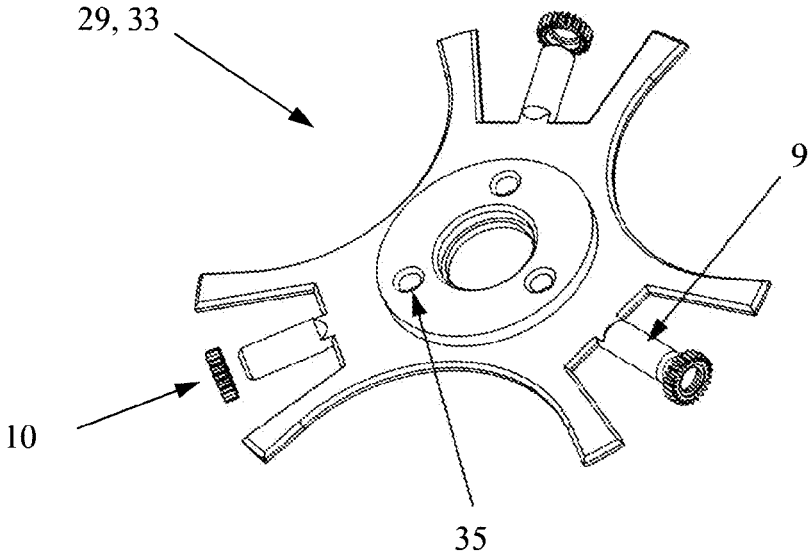
FIG. 17 is a perspective representation of a minute, hour or complication differential.

As can be seen in FIGS. 14 and 15, the underside of this minute cup (2) comprises a circular rack (28) arranged so that it engages with a second planetary gearing system via a minute differential (29) such as that illustrated diagrammatically in FIG. 17. The three pinions (10) of this differential (29) are arranged so that they mesh on one side with the circular rack (28) of the minute cup (2) and on the other side with a circular rack (not shown) arranged on the top side of a disk (30) similar to the disk (19) and forming an integral part of the second planetary gearing system. The latter comprises elements similar to the first planetary gearing system, namely three wheels termed hour satellites (31) arranged freely at each end of the shafts (20') of the disk (30), of a crowns (23') situated on the inner circumference of the hour cup (3) near its base, and of an hour pinion (22') set on the main pipe (15) of the movement.

By analogy with the first planetary gearing system described above, this second planetary gearing system allows the travel of the minute cup (2) to be demultiplied so that the hour cup (3) makes one rotation every 12 hours.

The horological movement can also comprise one or more complications. For example, the underside of the hour cup (3) can be provided near its periphery with a circular rack (32) in order to kinematically connect said hour cup with a day cup (not shown) via an hour differential (33) (FIG. 6) and an additional planetary gearing system similar to those described above so as to be able to indicate the date. In this case, the diameter of the hour cup (3) is less than the diameter of the day cup so that it can be arranged partially inside the latter.

The members for indicating the seconds, the minutes and the hours (1', 2', 3') and, where appropriate, the date, are mounted integrally with the cup for the seconds, the minutes and the hours (1, 2, 3) and, where appropriate, the days.

Figure 1:
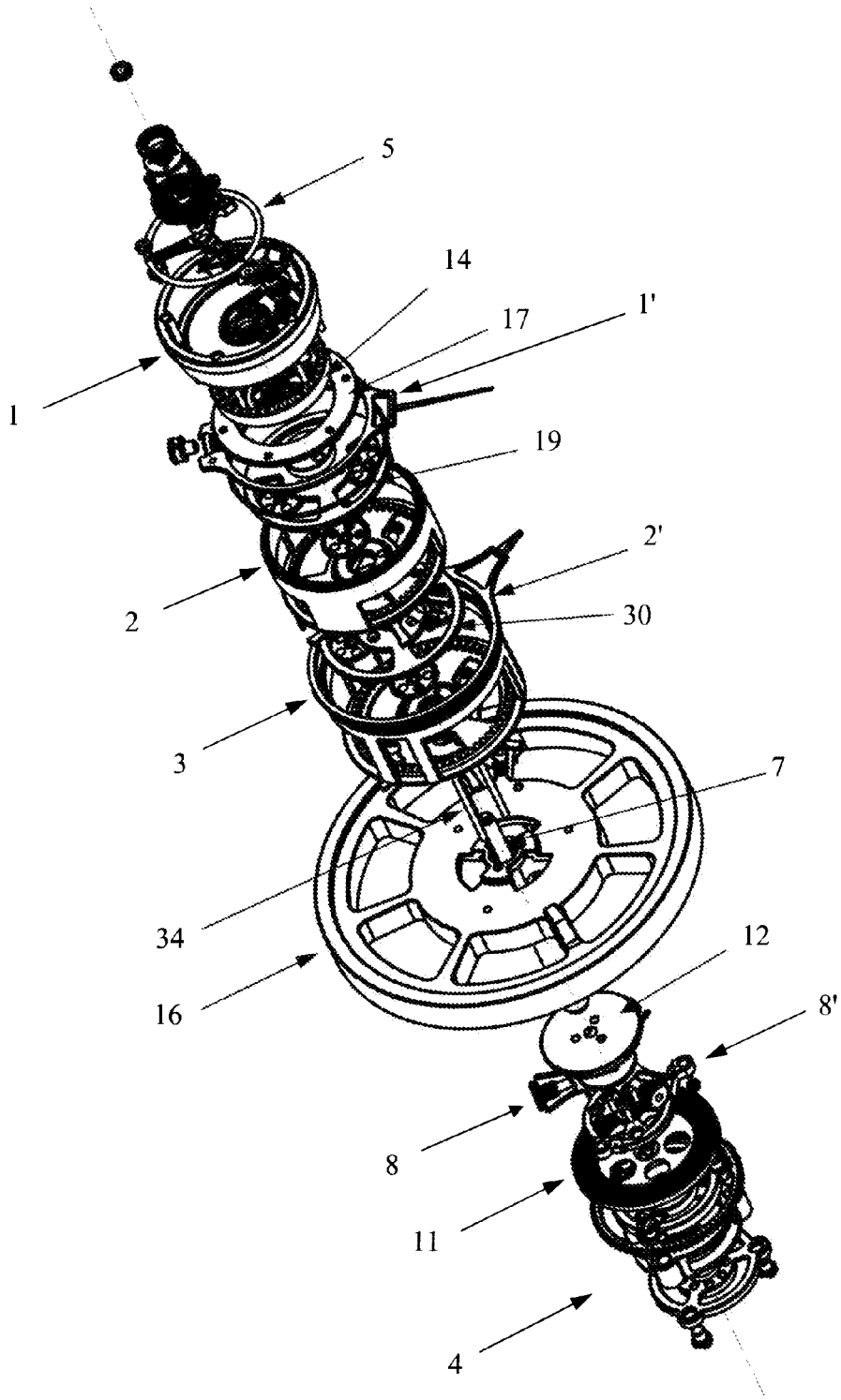
FIG. 1 shows an exploded perspective view of the horological movement according to the invention.
Figure 2:
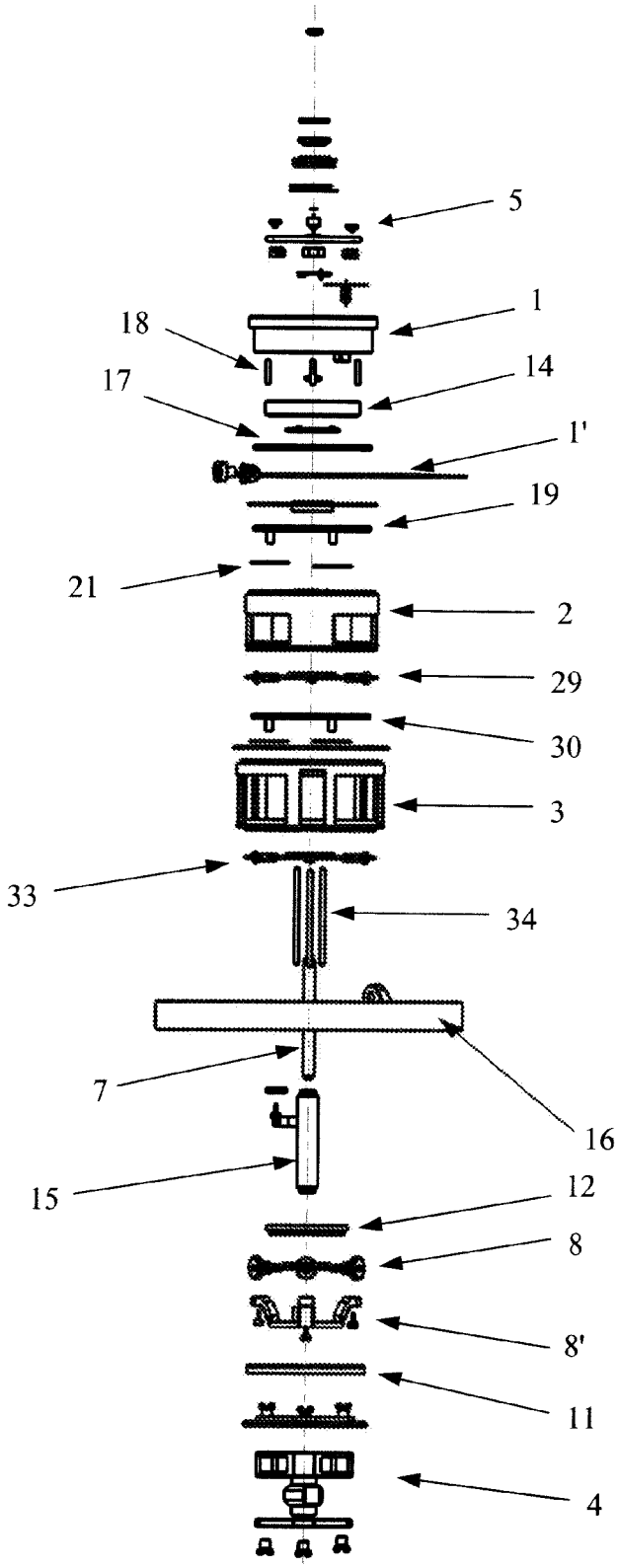
FIG. 2 shows an exploded front view of the horological movement.

As can be seen in FIGS. 1, 2 and 6, three securing arbors (34) are arranged on the plate (16) around the central pipe (15) of the movement at 120° to one another. These arbors (34) allow the different mechanical forces exerted by the movement to be distributed, and the structure supporting the various components of the movement to be strengthened.

Also, the barrel, minute and hour differentials (8, 29, 33), the securing disks (24, 24', 25) for the planetary gearing systems and the pinions (22, 22') all have three holes (35) that correspond to the positioning of the three securing shafts (34).

It goes without saying that the invention is not limited to the embodiment described above by way of example and, on the contrary, it encompasses all variant embodiments. By way of example, the cup of the tourbillon/seconds (1) can be arranged at any height on the main pipe (15), whereas the positioning of the cups (1, 2, 3) and the complications is dependent solely on the design of the movement. The gearing ratios are determined as a function of the positioning of the cups (1, 2 and 3).

The invention claimed is:

1. Horological movement comprising an energy accumulator (4), wheel units (1, 2, 3) on which are arranged time indicating members (1', 2', 3'), kinematic connection means creating multiplication and demultiplication ratios between the different wheel units (1, 2, 3) and a regulating member (5, 6), the energy accumulator (4), the wheel units (1, 2, 3) and the regulating member (5, 6) being arranged coaxially, characterized in that the horological movement also comprises a differential (8) arranged coaxially with the energy accumulator to provide the kinematic connection between the energy accumulator (4) and one of the wheel units (1, 2, 3) through a main arbor (7), and a main pipe (15) which is fitted coaxially around the main arbor (7), said pipe (15) being designed to support both the other wheel unit or units (1, 2, 3) and said kinematic connection means.

2. The horological movement as claimed in claim 1, characterized in that the energy accumulator is a barrel (4) and in that the regulating member consists of a balance and a balance spring (5, 6).

3. The horological movement as claimed in claim 2, characterized in that it comprises a second wheel unit (1) integral with one of the ends of the main arbor (7), the other end engaging with said differential (8) intended to multiply the travel of the barrel (4) to drive the seconds wheel unit (1) by one revolution per minute.

4. The horological movement as claimed in claim 3, characterized in that a minute wheel unit (2) and an hour wheel unit (3) are arranged around the main pipe (15) and arranged respectively beneath the second wheel unit (1) and beneath the minute wheel unit (2).

5. The horological movement as claimed in claim 4, characterized in that a day wheel unit is arranged around the main pipe (15) and arranged beneath the minute wheel unit (2).

6. The horological movement as claimed in claim 1 or 5, characterized in that seconds, minute, hour and day wheel units (1, 2, 3) are similar to respective cups.

7. The horological movement as claimed in claim 6, characterized in that the balance/balance spring (5, 6) is arranged inside and at the center of the seconds cup (1).

8. The horological movement as claimed in claim 6, characterized in that the cups for the seconds (1), the minutes (2) and the hours (3) are arranged partially inside the cups for the minutes (2), the hours (3) and the days respectively.

9. The horological movement as claimed in claim 6, characterized in that indicators for the hours (3'), the minutes (2') and the seconds (1') are arranged integrally and respectively on the cups for the hours (3), the minutes (2) and the seconds (1), on their respective outer perimeter.

10. Wristwatch comprising the horological movement as claimed in claim 1.

* * * * *